US010836203B2

(12) United States Patent
Parker et al.

(10) Patent No.: US 10,836,203 B2
(45) Date of Patent: Nov. 17, 2020

(54) REFILL FRIENDLY PEN BODY

(71) Applicants: Chadwick Parker, Chattanooga, TN (US); Zheng Huang, Chattanooga, TN (US)

(72) Inventors: Chadwick Parker, Chattanooga, TN (US); Zheng Huang, Chattanooga, TN (US)

( * ) Notice: Subject to any disclaimer, the term of this patent is extended or adjusted under 35 U.S.C. 154(b) by 0 days.

(21) Appl. No.: 16/183,306

(22) Filed: Nov. 7, 2018

(65) Prior Publication Data

US 2019/0135023 A1 May 9, 2019

Related U.S. Application Data

(60) Provisional application No. 62/582,408, filed on Nov. 7, 2017.

(51) Int. Cl.

| | |
|---|---|
| ***B43K 7/00*** | (2006.01) |
| ***B43K 7/02*** | (2006.01) |
| ***B43K 23/12*** | (2006.01) |
| ***B43K 5/00*** | (2006.01) |
| ***B43K 5/14*** | (2006.01) |

(52) U.S. Cl.

CPC ..... *B43K 7/005* (2013.01); *B43K 5/005* (2013.01); *B43K 5/14* (2013.01); *B43K 7/02* (2013.01); *B43K 23/12* (2013.01)

(58) Field of Classification Search

CPC ..... B43K 7/005; B43K 7/02; B43K 11/00; B43K 23/12; B43K 5/0005; B43K 5/14

See application file for complete search history.

(56) References Cited

U.S. PATENT DOCUMENTS

| | | | | |
|---|---|---|---|---|
| 2,312,136 A * | 2/1943 | Van Triest | ..... | G01B 5/28 401/48 |
| 3,945,733 A * | 3/1976 | Edel | ..... | B43K 21/04 401/94 |
| 6,793,429 B2 * | 9/2004 | Arrison | ..... | B43K 23/016 401/117 |
| 9,004,794 B2 * | 4/2015 | Whigham | ..... | B43K 24/00 401/88 |

* cited by examiner

*Primary Examiner* — David J Walczak

(74) *Attorney, Agent, or Firm* — Dunlap Bennett & Ludwig, PLLC; Brendan E. Squire

(57) ABSTRACT

A refill friendly pen body that is configured to adapt to a refill cartridge of various dimensional parameters. An adjustment cylinder is adjustably carried within a barrel to adapt the pen body to a length of the refill cartridge. A grip end of the pen body is configured with an internal collet to compressively engage with a forward end of the cartridge across to retain the forward end of the cartridge in a writing position. The pen body may also be provided with a cap to selectively cover and uncover the writing tip.

16 Claims, 4 Drawing Sheets

REFILL FRIENDLY PEN BODY

CROSS-REFERENCE TO RELATED APPLICATION

This application claims the benefit of priority of U.S. provisional application No. 62/582,408, filed Nov. 7, 2017, the contents of which are herein incorporated by reference.

BACKGROUND OF THE INVENTION

The present invention relates to pen writing implements, and more particularly to pens with a replaceable ink cartridge.

There are many pens on the market that provide capabilities to replenish the ink supply for a pen once the ink carried by the pen has been depleted. Typically, the ink supply is carried in a cartridge that the user may replace, such as by opening the pen body and installing a new cartridge.

While the concept of ink cartridges seems simple enough, the challenge for the user is finding a suitable source of replacement cartridges that are compatible with the particular pen body. For example, the cartridge may not be carried at the store in which the user purchased the pen. Likewise, instructions and specifications for the cartridge may be carried on the product packaging, which is typically thrown away after beginning use of the pen. Accordingly, the user is left with the need to find a replacement cartridge without much guidance.

The user may attempt to order a cartridge, based on a visual similarity, but the cartridge man not actually fit the pen body due to the myriad of pen cartridges and dimensional specifications for the same.

As can be seen, there is a need for a improved pen body that is configured as a universal acceptor of a replacement ink cartridge.

SUMMARY OF THE INVENTION

In one aspect of the present invention, a pen body is disclosed that is adapted to receive an ink cartridge refill. The pen body includes an outer barrel having an interior cavity defined through a longitudinal length thereof. An adjustment cylinder is adjustably received within the interior cavity. The adjustment cylinder has an interior channel dimensioned to receive an aft end of an ink cartridge. A grip section is adjustably attached to a front end of the outer barrel and a collet is received within the grip section, such that a tip of the collet is configured to compressively engage around an outer diameter of a forward end of the cartridge.

The collet may also have an annular ring defined within an interior of the collet. The annular ring is configured to abut a shoulder of the ink cartridge. At least one radially defined slot may extend from an interior to an exterior of the collet. An aft end of the collet is urged in abutment with a forward end of the outer barrel.

A longitudinal length of the pen body is adjustable via rotation of the adjustment cylinder. A stop may be defined within the interior channel, wherein the stop is urged against an aft end of the cartridge.

In other aspects of the invention, a pen body is adapted to receive an ink cartridge refill. The pen body includes an outer barrel having an interior cavity defined through a longitudinal length thereof. An adjustment cylinder is received within the interior cavity, wherein rotation of the adjustment cylinder selectively extends and retracts a longitudinal length of the interior of the pen body to adapt to a length of an ink cartridge refill received therein. A grip section is attached to a front end of the outer barrel. A collet is received within the grip section, wherein a tip of the collet is configured to compressively engage around an outer diameter of a forward end of the cartridge.

The collet may also have an annular ring defined within an interior of the collet, wherein each of the plurality of annular rings have a progressively smaller inner diameter adapted to receive a shoulder of the ink cartridge. At least one radially defined slot extends from an interior to an exterior of the collet. An aft end of the collet may be urged in abutment with a forward end of the outer barrel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention a refill friendly pen body that is configured as a universal acceptor for an ink refill cartridge.

Figure 1:
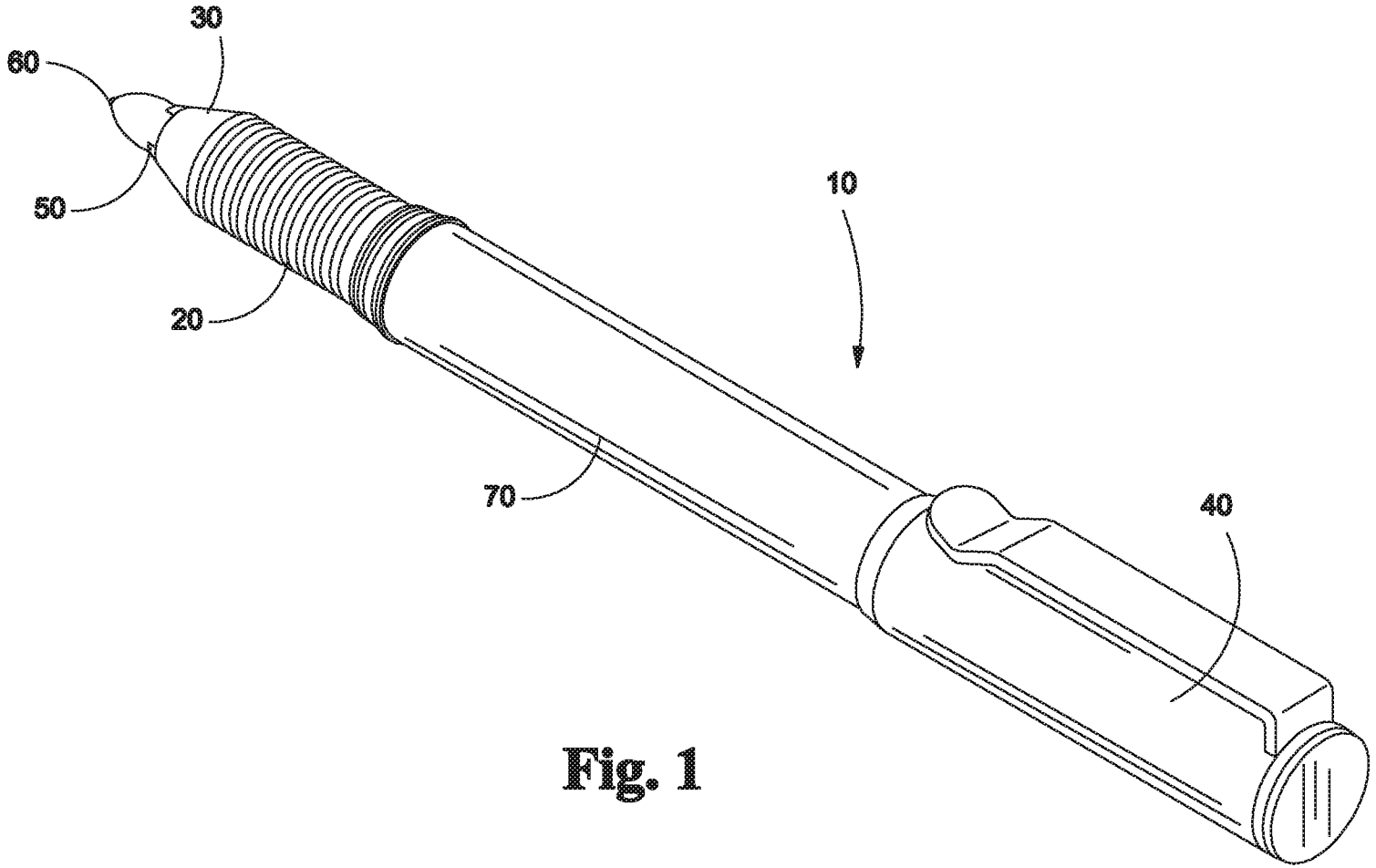
FIG. 1 is a perspective view of the refill friendly pen.
Figure 2:
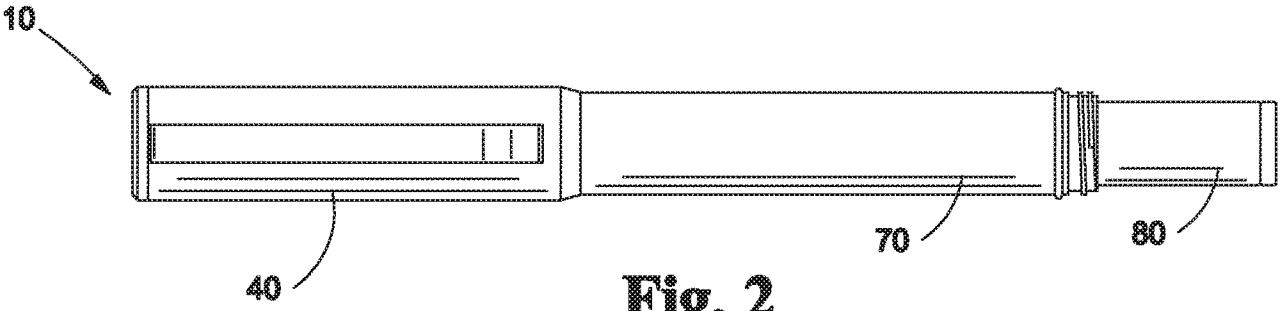
FIG. 2 is a front elevation view of the refill friendly pen in a closed configuration.
Figure 3:
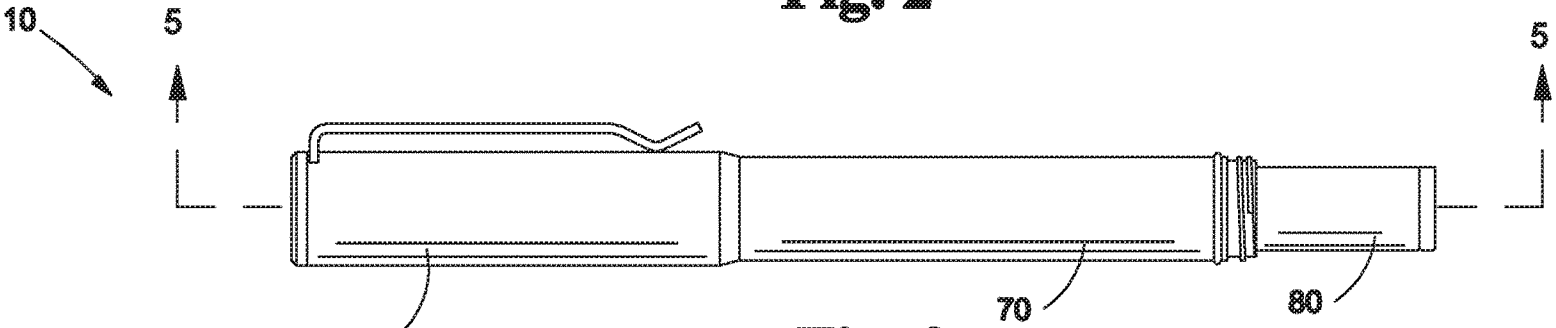
FIG. 3 is a side elevation view of the refill friendly pen in a closed configuration.
Figure 4:
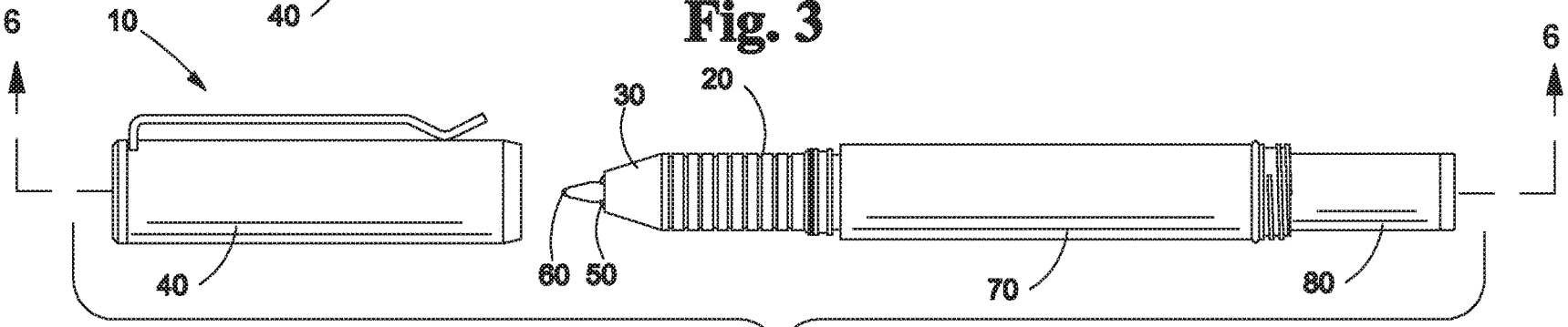
FIG. 4 is a side elevation view of the refill friendly pen in an open configuration.
Figure 5:
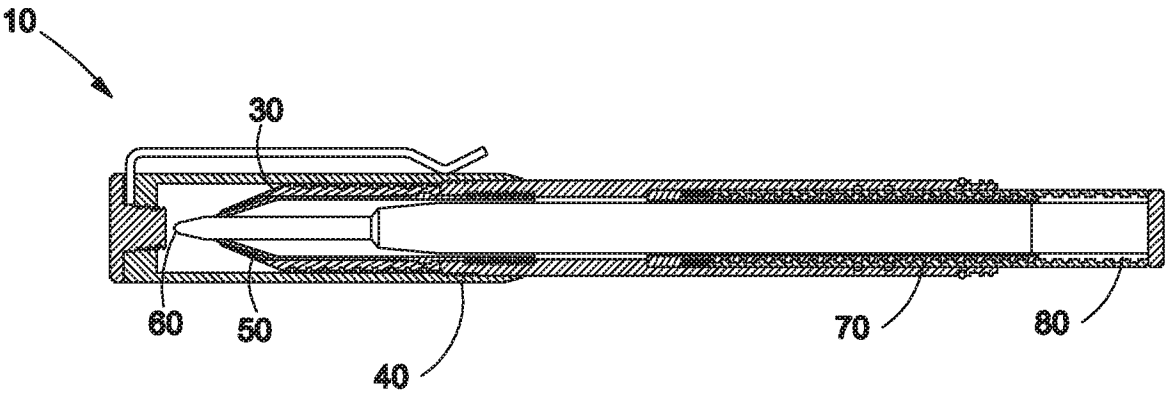
FIG. 5 is a side sectional view of the refill friendly pen along line 5-5 of FIG. 3.
Figure 6:
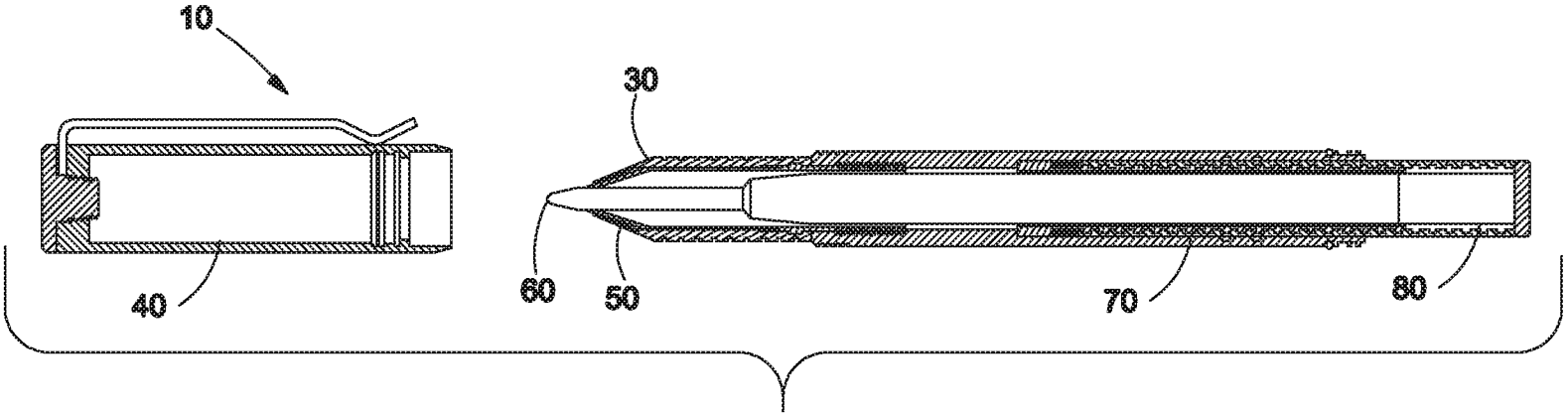
FIG. 6 is a side sectional view of the refill friendly pen along line 6-6 of FIG. 4.
Figure 7:
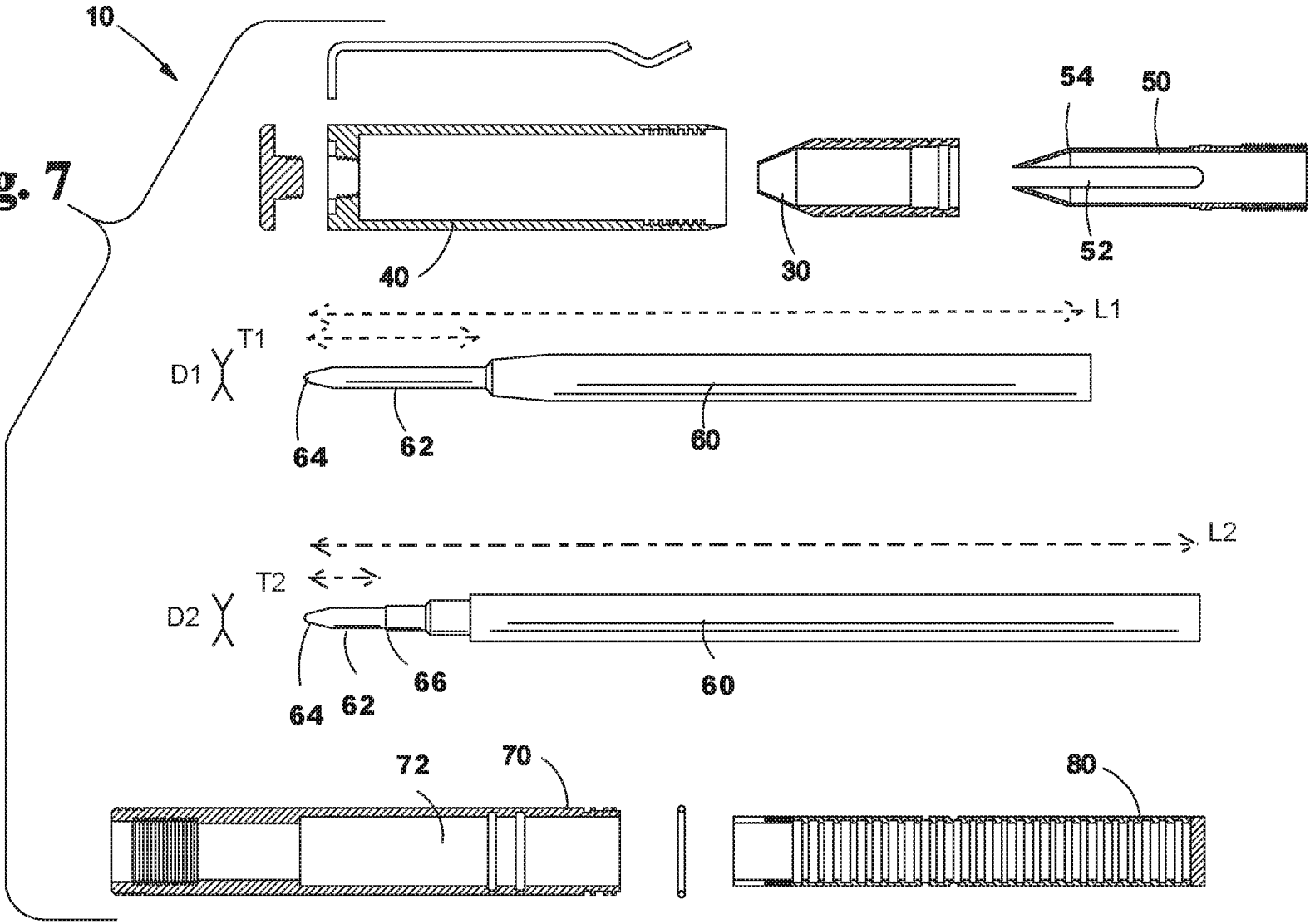
FIG. 7 is an exploded view of the refill friendly pen.

As seen in reference to the drawings of FIGS. 1-7, a universal refill pen 10 is shown according to a preferred embodiment of the present invention. The universal refill pen 10 includes a removable cap 40 to selectively cover a front writing end of the pen 10.

A grip section 30 is provided at a forward end of the pen 10. The grip section 30 may include a frictional outer surface, such as a plurality of rings 20, to facilitate the gripping of the pen 10. A forward end of the grip section 30 has a frusto-conical shape converging towards the tip. The grip 30 has an interior cavity configured to receive at least one collet 50 for adapting the pen 10 to a forward end 62 of an ink cartridge 60. An aft end of the grip section 30 is attached to an outer barrel 70 at a forward end thereof. Preferably, the grip 30 is threadingly attached to the outer barrel 70. More preferably, the grip 30 is captively retained on the threads to permit a tightening or loosening adjustment of the collet 50 about a forward end 62 of a cartridge 60.

The outer barrel 70 has an interior cavity extending through a longitudinal length of the barrel. A portion of the interior cavity is dimensioned to threadingly receive an adjustment cylinder 80. The adjustment cylinder 80 has an opening at a forward end and an interior channel dimensioned to receive an aft end of the cartridge 60. An aft end of the adjustment cylinder 80 includes a stop for abutment with an aft end of the cartridge 60. The rotation of the adjustment cylinder 80 within the barrel 70 adjusts the longitudinal length of the pen 10 to accommodate a longitudinal length L1, L2 of the cartridge 60 carried therein. The adjustment cylinder 80 may include a frictional outer surface to facilitate twisting of the adjustment cylinder 80.

The at least one collet 50 has a frusto-conical forward tip dimensioned to be received within the grip section 30. The collet 50 has at least one radially defined slot 52 such that the tip of the collet 50 may be compressively urged around an outer diameter D1, D2 of a forward end 62 of the cartridge 60 between the shoulder 66 and the writing tip 64. An aft end of the collet 50 is threadingly engaged with a forward end of the outer barrel 70 when the grip 30 is threadingly engaged with the barrel 70. The collet 50 is configured to automatically contract around and retain the forward end 62 of the cartridge 60 when the grip section 30 is secured to the barrel 70. The compressive forces of the collet 50 may be adjusted by the treaded engagement of the grip section 30 with the barrel 70. The adjustment cylinder 80 is then rotated to adjust the length of the pen 10 to the longitudinal lengths L1, L2 of the cartridge 60. The tip length T1, T2, or writing length of the cartridge tip 64 may thus be adjusted. Once a desired writing length T1, T2 is selected, the grip section 30 may then be tightened to apply a compressive force to the collet 50 and secure the tip 64 in place at the desired writing length T1, T2. As may be seen in reference to FIG. 7, each of a plurality of cartridges 60 may have a dissimilar tip length T1, T2, tip outer diameter D1, D2, and longitudinal length L1, L2. In some embodiments, an annular ring 54 is defined within an interior of the collet 50, wherein the annular ring 54 is adapted to abut a shoulder 66 of the ink cartridge.

In some embodiments, the barrel 70 may include a retainer on one or more ends of the barrel 70 to secure the cap 40 to the barrel 70. The retainer may include an annular ring, for a snap fit engagement with the cap 40. In other embodiments, the retainer may include a threaded coupling with a corresponding thread in the cap 40.

It should be understood, of course, that the foregoing relates to exemplary embodiments of the invention and that modifications may be made without departing from the spirit and scope of the invention as set forth in the following claims.

What is claimed is:

1. A pen body adapted to receive an ink cartridge refill, comprising:

a first removable ink cartridge refill having a first writing tip length, a first writing tip outer diameter, and a first longitudinal length;

an outer barrel having an interior cavity defined through a longitudinal length thereof;

an adjustment cylinder adjustably received within the interior cavity, the adjustment cylinder having an interior channel receiving an aft end of the first removable ink cartridge refill within the interior channel, the adjustment cylinder adapted to receive an aft end a second removable ink refill cartridge having a second longitudinal length, when the first removable ink cartridge is removed from the pen body;

a grip section adjustably attached to a front end of the outer barrel; and a collet received within the grip section, wherein a tip of the collet compressively engages around the first writing tip outer diameter of the first removable ink cartridge refill, and the tip of the collet is configured to compressively engage a second writing tip outer diameter of the second ink removable cartridge refill, when the first removable ink cartridge is removed from the pen body.

2. The pen body of claim 1, further comprising:

an annular ring is defined within an interior of the collet, wherein the annular ring is adapted to abut a shoulder of the first removable ink cartridge.

3. The pen body of claim 1, further comprising:

at least one radially defined slot extending from an interior to an exterior of the collet.

4. The pen body of claim 3, wherein an aft end of the collet is urged in abutment with a forward end of the outer barrel.

5. The pen body of claim 1, wherein a longitudinal length of the pen body is adjustable via rotation of the adjustment cylinder.

6. The pen body of claim 5, further comprising:

a stop defined within the interior channel, wherein the stop is urged against an aft end of the first removable ink cartridge.

7. A pen body adapted to receive an ink cartridge refill, comprising:

a first ink cartridge refill having a first writing tip length, a first writing tip outer diameter, and a first longitudinal length;

an outer barrel having an interior cavity defined through a longitudinal length thereof;

an adjustment cylinder received within the interior cavity, wherein rotation of the adjustment cylinder selectively extends and retracts a longitudinal length of the interior of the pen body such that the first ink cartridge refill is received in an interior channel of the adjustment cylinder, and rotation of the adjustment cylinder adapts the longitudinal length of the pen body to a longitudinal length of a second ink cartridge refill for reception within the interior channel when the first ink cartridge refill is removed from the pen body;

a grip section attached to a front end of the outer barrel; and a collet received within the grip section compressively engages around the first writing tip outer diameter of the first ink cartridge refill, and the collet is configured to compressively engage around a forward end of the second ink cartridge refill, when the first ink cartridge refill is removed from the pen body.

8. The pen body of claim 7, further comprising:

at least one radially defined slot extending from an interior to an exterior of the collet.

9. The pen body of claim 8, wherein an aft end of the collet is urged in abutment with a forward end of the outer barrel.

10. The pen body of claim 9, wherein the longitudinal length of the pen body is adjustable via rotation of the adjustment cylinder.

11. A pen body adapted to selectably receive a plurality of ink cartridge refills, each having one or more of a dissimilar longitudinal length and a dissimilar writing tip length, comprising:

a selected ink refill cartridge chosen from the plurality of ink cartridge refills;

an outer barrel having an interior cavity defined through a longitudinal length thereof;

an adjustment cylinder adjustably received within the interior cavity, the adjustment cylinder having an interior channel dimensioned to adjustably receive an aft end of the selected ink refill cartridge within the interior channel, wherein rotation of the adjustment cylinder relative to the outer barrel adjusts a longitudinal length of the pen body to accommodate the dissimilar longitudinal length of the selected ink refill cartridge;

a grip section adjustably attached to a front end of the outer barrel; and a collet received within the grip section, wherein a tip of the collet is configured to compressively engage a forward end of the ink cartridge refill to adjustably accommodate the dissimilar writing tip length of the selected ink refill cartridge.

12. The pen body of claim 11, further comprising:

an annular ring is defined within an interior of the collet, wherein the annular ring is adapted to abut a shoulder of the selected ink refill cartridge.

13. The pen body of claim 11, further comprising:

at least one radially defined slot extending from an interior to an exterior of the collet.

14. The pen body of claim 13, wherein an aft end of the collet is urged in abutment with a forward end of the outer barrel.

15. The pen body of claim 11, wherein a longitudinal length of the pen body is adjustable via rotation of the adjustment cylinder.

16. The pen body of claim 15, further comprising:

a stop defined within the interior channel, wherein the stop is urged against an aft end of the selected ink refill cartridge.

* * * * *